United States Patent [19]

Paddock

[11] Patent Number: 4,715,831

[45] Date of Patent: Dec. 29, 1987

[54] WIRING FOR REFRIGERATION APPARATUS

[75] Inventor: Stephen W. Paddock, Knight Township, Vanderburg County, Ind.

[73] Assignee: Whirlpool Corporation, Benton Harbor, Mich.

[21] Appl. No.: 435,895

[22] Filed: Oct. 22, 1982

[51] Int. Cl.[4] ..... H01R 9/24

[52] U.S. Cl. ..... 439/709

[58] Field of Search ..... 339/176 M, 18 R, 18 B, 339/18 C, 18 P, 198 R, 198 S, 198 P; 439/709–722

[56] References Cited

U.S. PATENT DOCUMENTS

| | | | |
|---|---|---|---|
| 3,345,599 | 10/1967 | Henschen et al. | 339/18 C |
| 3,697,927 | 10/1972 | Kunkle et al. | 339/176 M |
| 3,771,102 | 11/1973 | Murray et al. | 339/18 |
| 3,922,478 | 11/1975 | Perkey | 339/18 R |
| 4,429,943 | 2/1984 | Inoue | 339/198 R |

FOREIGN PATENT DOCUMENTS

| | | | |
|---|---|---|---|
| 2499775 | 8/1982 | France | 339/176 M |
| 55-2038 | 2/1980 | Japan . | |

*Primary Examiner*—John McQuade

*Attorney, Agent, or Firm*—Wood, Dalton, Phillips, Mason & Rowe

[57] ABSTRACT

A wiring structure for a refrigeration apparatus having a plurality of electrical components. A plurality of multiple terminal connectors each receive at least two of selected leads from various ones of the electrical components and are received in a terminal block having a plurality of side-by-side, elongated connection stations. A plurality of electrically separated busses in the terminal block extend linearly between various ones of the stations. Use of the structure minimizes assembly labor and prevents wiring errors.

4 Claims, 4 Drawing Figures

WIRING FOR REFRIGERATION APPARATUS

BACKGROUND OF THE INVENTION

1. Field of the Invention

This invention relates to refrigeration apparatus, and more specifically, to an improved wiring construction for the electrical components of such apparatus that assures the proper wiring of the components and reduces assembly time.

2. Background Art

Prior art of possible relevance includes the following U.S. Pat. No. 3,405,986 issued Oct. 15, 1968 to Cannon; U.S. Pat. No. 3,460,352 issued Aug. 12, 1969 to Lorenz; U.S. Pat. No. 3,736,765 issued June 5, 1973 to O'Dell; and U.S. Pat. No. 3,771,321 issued Nov. 13, 1973 to Maksy.

As is well known, electrical refrigeration apparatus, such as refrigerators, freezers, or combination refrigerator-freezers, have become increasingly more complicated in the electrical sense over the years. To the basic minimum of a compressor, a cabinet light, and a thermostat, modern refrigeration apparatus now frequently includes a heater for defrosting, a timer for controlling the defrosting heater, a safety device to prevent overheating of the defrost heater, an evaporator fan, a mullion heater, and possibly other electrical components as, for example, an ice maker. As a consequence, the electrical wiring of a refrigeration apparatus has become more complicated. This, in turn, presents two major difficulties. One is the added expense involved in wiring the additional components. The other is that the greater number of components increases the possibility of wiring errors.

Heretofore, refrigeration apparatus manufactured by the assignee of the present application has attempted to minimize the foregoing problems through the use of a terminal board contained within the cabinet or housing for the refrigerating apparatus. The individual leads for each of the electrical components are provided with a spade terminal of conventional construction and each then individually fitted to an appropriate one of several terminal strips forming part of the terminal block. As can be readily appreciated, the individual fitting of each lead to a terminal strip is time consuming. Moreover, the nature of the process is such that the spade terminal on a given lead may be improperly applied to the wrong terminal strip producing a wiring error.

The present invention is directed to overcoming the above problems.

SUMMARY OF THE INVENTION

It is a principal object of the invention to provide a new and improved wiring structure for use in refrigeration apparatus. More specifically, it is an object of the invention to provide an improved wiring structure that reduces the labor required to complete the wiring of a refrigeration apparatus and/or reduces or eliminates wiring errors. It is a further object of the invention to provide an improved wiring structure which provides the foregoing advantages and is configured so as to minimize the amount of bus bar and connector materials associated with the structure.

An exemplary embodiment of the invention achieves the foregoing objects in a refrigeration system including a housing adapted to define a refrigerated space. A plurality of electrical components are operatively associated with the housing for refrigerating the space in a controlled fashion and there is provided a power supply and control circuit for the electrical components including leads extending between the electrical components to provide power thereto and to exercise the desired mode of control thereover. The circuit has a plurality of nodes, at least some of which are common to a plurality of the components. The invention contemplates that the refrigeration system be provided with a terminal block mounted within the housing and including a plurality of busses, one for each circuit node, extending parallel to each other. Means are associated with the terminal block to define a plurality of multiple terminal connection stations. Selected ones of the leads include multiple terminal connectors for receipt at predetermined ones of the connection stations.

In a highly preferred embodiment of the invention, the connection stations and the connectors are linear with the connection stations being generally transverse to the busses.

Preferably, the number of connecting stations served by each bus varies and the bus serving the greatest number of connection stations is located centrally of the remaining busses. In addition, the number of busses associated with each connection station varies and the connection station associated with the most busses is located centrally of the remaining connection stations.

In a highly preferred embodiment, the central bus and central connection station define four quadrants and the remaining connection stations and busses are located solely in two opposite ones of the quadrants.

As a consequence of the foregoing features, wiring installation time is considerably decreased as are wiring errors. The cost and size of the wiring structure thus defined are, however, advantageously small.

Other objects and advantages will become apparent from the following specification taken in connection with the accompanying drawings.

DESCRIPTION OF THE PREFERRED EMBODIMENT

Figure 1:
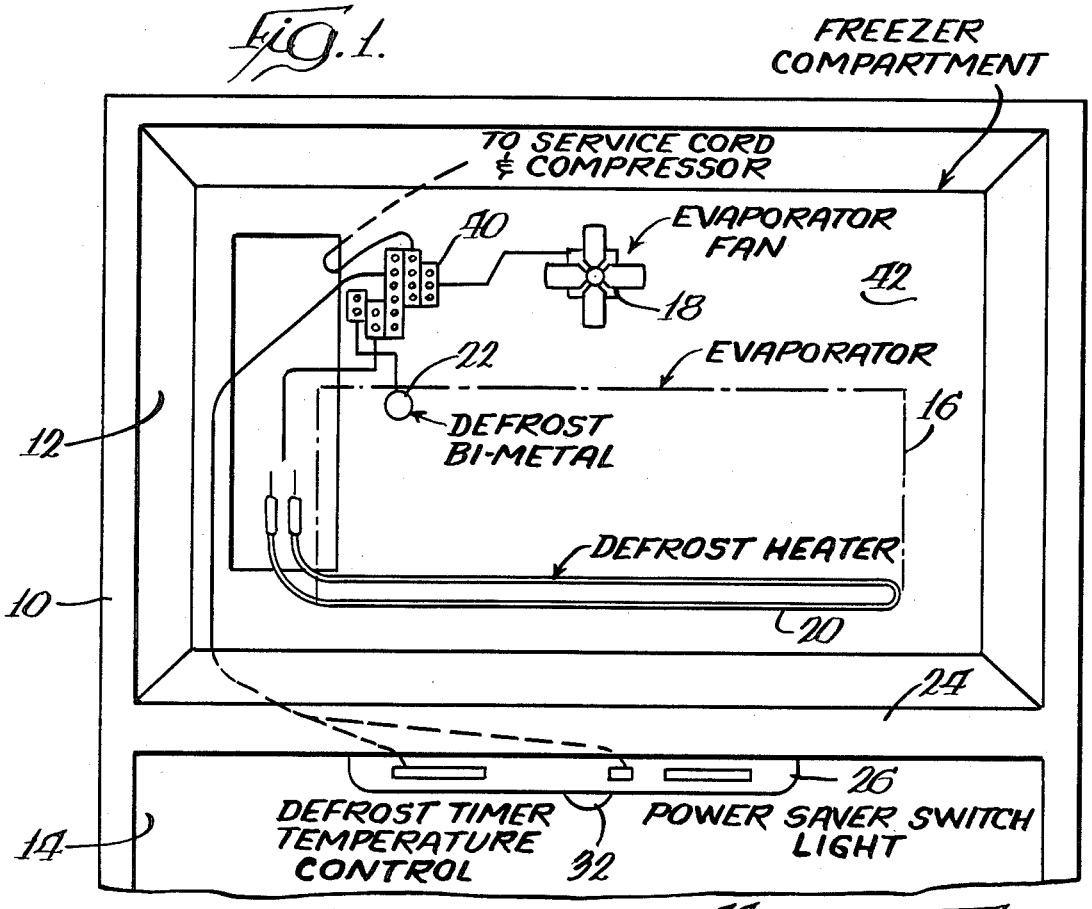
FIG. 1 is a somewhat schematic, front elevational view of part of a refrigeration apparatus made according to the invention.

An exemplary embodiment of a refrigeration apparatus made according to the invention is illustrated in the drawings and with reference to FIG. 1, the same is illustrated in the form of a combination refrigerator-freezer. However, it is to be understood that the invention is applicable to other refrigeration apparatus as, for example, refrigerators or freezers. The apparatus includes a cabinet 10 defining an upper freezer compartment 12 and a lower fresh food compartment 14. Conventional doors (not shown) are employed to close both.

As illustrated in FIG. 1, a rear panel (not shown) of the freezer compartment 12 has been removed revealing certain system components. For example, there is included a conventional evaporator 16 shown in phantom lines and an associated evaporator fan 18. Though not ordinarily visible, there may be seen a conventional defrost heater 20 and a so-called defrost bimetal 22.

The compartments 12 and 14 are separated by a mullion 24 and a control console 26 is located adjacent the lower edge of the mullion 24, within the compartment 14. As is well known, the control console 26 may house a defrost timer 28 (FIG. 2) for controlling the cycling of the defrost heater 20, a thermostat 30 (FIG. 2) for controlling the temperature maintained within the compartment 14, a cabinet light 32 for illuminating the interior of the compartment 14 and a power saver or select switch 34 (FIG. 2) for controlling, in part, the operation of a conventional mullion heater 36 (FIG. 2) disposed within the mullion 24.

A terminal block 40 made according to the invention is mounted on the rear wall 42 of the compartment 12 and various electrical leads, to be described in greater detail hereinafter, are connected thereto to assure proper interaction of the various components to control operation of the refrigeration apparatus in a given desired mode.

Figure 2:
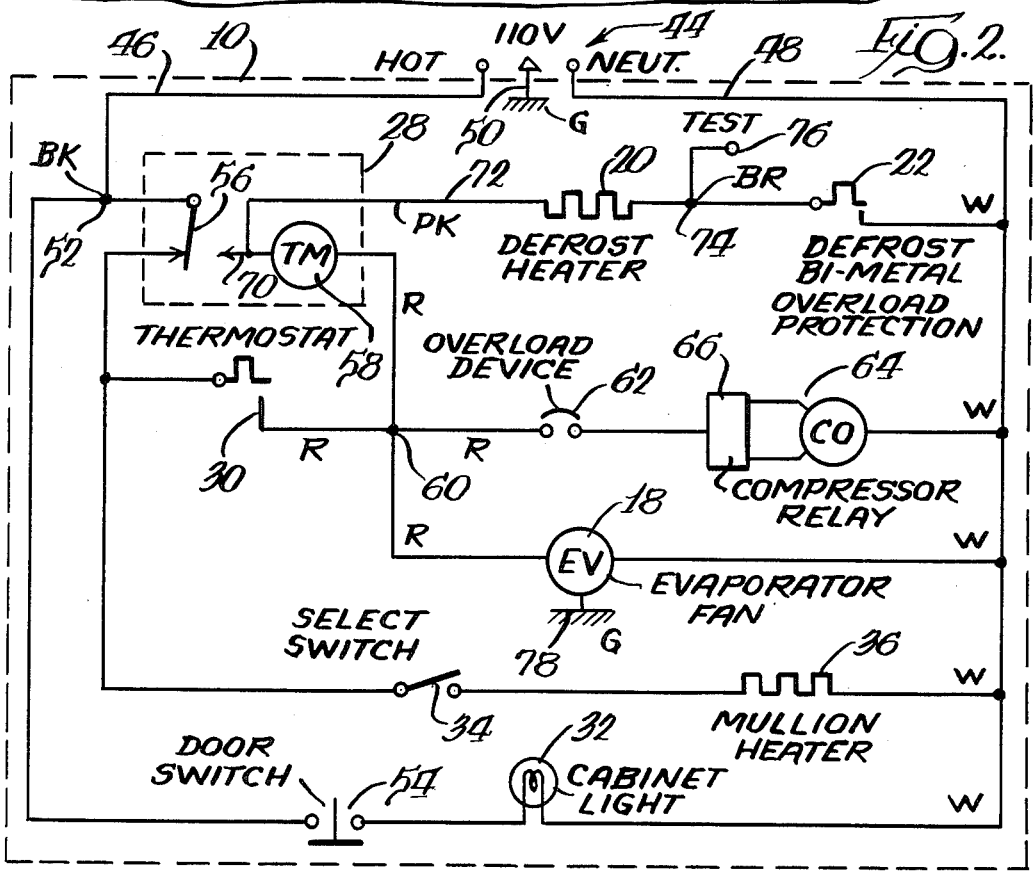
FIG. 2 is an electrical schematic illustrating a refrigeration apparatus control circuit to which the invention has been applied.

Turning now to FIG. 2, there is illustrated a conventional electrical schematic for control of the refrigeration apparatus. The same includes a conventional three pronged plug, generally designated 44 on the end of a flexible cord for connection to a standard alternating current power source. One input lead, colored black as is conventional and designated 46 is a so-called "hot" line while another, conventionally colored white and designated 48, is neutral. A third, conventionally colored green and designated 50, is a ground line.

The hot line 46 is connected at a circuit node 52 to the defrost timer 28 and to a door operated switch 54 which is in series with the cabinet light 32, which is then connected to a second circuit node defined by the neutral line 48. Within the defrost timer 28 there is a single pole, double throw switch 56 which is operated by a timer motor 58 in a conventional fashion. In the position shown, the switch 56 provides power to the refrigeration system thermostat 30 which is connected to a third node 60 in the circuit. The node 60 is also connected to the timer motor 58, to the evaporator fan 18 which is also connected to the second node 48, and to the serial combination of a thermal overload 62 and compressor system 64 including a compressor relay 66, which is returned to the line 48. Connections to the circuit node 60 are by way of example, made with red wire.

The defrost timer switch 56 may also close through a contact 70 which extends to an external lead 72 defining a fourth circuit node and having pink insulation. The lead 72 extends to the defrost heater 20 which is in series with the defrost bimetal 22 to the second node 48. Between the defrost heater 20 and the defrost bimetal 22 is a fifth circuit node 74 which may be defined by brown insulated wire and to which is connected a test point 76. The circuit is completed by the serial combination of the switch 34 and the mullion heater 36 connected from the second circuit node 48 to the defrost timer side of the thermostat 30 and by a grounded connection 78 by green insulated wire to the evaporator fan 18.

Operation of the circuit will be readily apparent to those skilled in the art. For present purposes, it is sufficient to say that the door operated switch 54 controls energization of the cabinet light 32 while the mullion heater 36 will be energized at all times that the refrigeration system is not undergoing a defrost cycle provided that the manually operated switch 34 is closed. The compressor 64 and evaporator fan 18 will be energized whenever the thermostat 30 dictates such to be the case, provided that the defrost heater 20 is not energized and there is no overload causing the thermal overload 62 to disengage the relay 66 and thus the compressor 64.

When the timer motor 58 has cycled sufficiently to cause the switch 56 to close against the contact 70, the defrost heater 20 will be energized and will remain energized until the switch 56 is again open, provided that the defrost bimetal switch 22 does not open due to excessive heat generated during the defrost cycle.

Figures 3, 4:
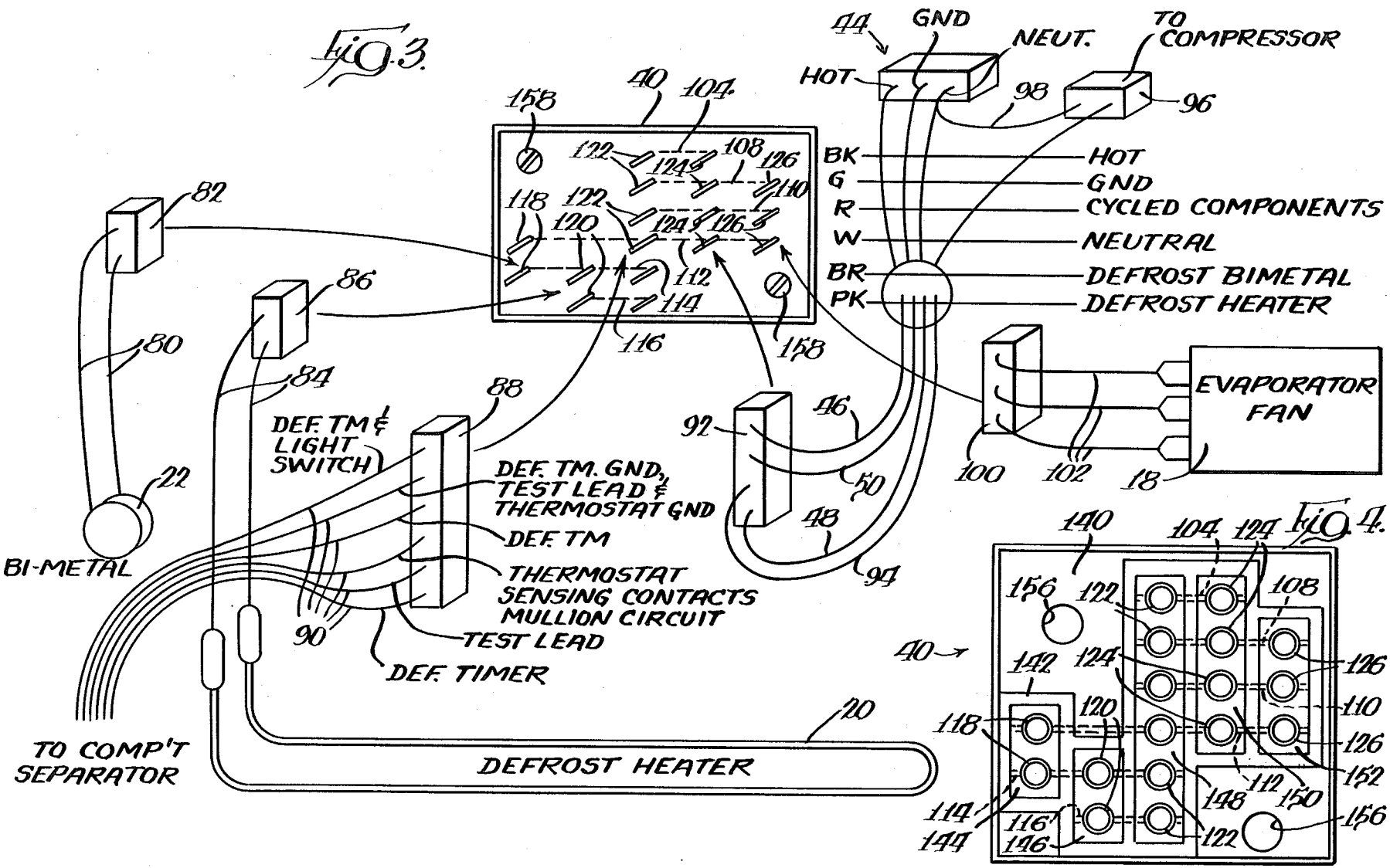
FIG. 3 is a somewhat schematic, exploded view of the physical structure of the electrical system embodying the invention.
FIG. 4 is a plan view of a preferred form of terminal block employed in the refrigeration system.

Referring now to FIG. 3, the wiring structure of the present invention will be described in greater detail. As seen, the defrost bimetal 22 has a wiring harness formed by a pair of leads 80 extending from the defrost bimetal 22 to a two terminal female connector 82. The connector 82 is elongated with the leads defining a straight line as will be appreciated by those skilled in the art.

The defrost heater 20 is connected by a wiring harness defined by a pair of leads 84 extending to a similar connector 86.

An elongated, six terminal connector 88 has a six wire wiring harness defined by leads 90 which extend to the indicated electrical components associated with the mullion 24 and the control console 26 as illustrated in the schematic of FIG. 2. As will be seen, the connector 88 is associated with the terminal block 40 while the harness defined by the leads 90 extends through any suitable opening through the interior of the mullion 24 to the control console 26. Again, the connector 88 is elongated with the six terminals being located in a straight line.

A four terminal connector 92 serves both input and control purposes. One lead 46 is connected to the hot side of power via the conventional plug 44 while a lead 50 is likewise grounded. A third lead 48 is connected to the neutral side of power while a fourth 94 extends to a connector 96 by which power may be supplied to the overload device 62 and the compressor 64, 66. The connector 96 also includes a line 98 connected by any suitable means to the neutral line terminal 48.

A three terminal connector 100, also elongated and with its terminals in a straight line, is connected by leads 102 to the evaporator fan 18.

The terminal block 40 is also schematically illustrated in FIG. 3 and is seen to include, in the exemplary embodiment, a series of six, geometrically parallel, side-by-side electrical busses 104, 108, 110, 112, 114, and 116.

Each of the busses 104–116 has associated with it at least two male terminals for receipt in particular ones of the female connectors 82, 86, 88, 92 and 100. For example, two male terminals 118 associated with the busses 112 and 114 are adapted for receipt in the connector 82. Two additional terminals 120, associated with the busses 114 and 116 are adapted for receipt in the connector 86. A series of six terminals 122, one associated with each of the busses 104–116, are adapted for receipt in the connector 88 while a series of four terminals 124 are adapted to be received in the connector 92. The terminals 124 are associated with the busses 104–112, respectively. Finally, three terminals 126, are adapted to be received in the connector 100 and are associated with the busses 108–112, respectively.

It will be observed that each set of terminals designed for receipt in a specific connector are arranged in a straight line which is transverse to the busses 104–116, inclusive. It will also be observed that each set of terminals defines a separate connection station with the terminal set 122 having the greatest number of terminals being located centrally of the remainder. Similarly, the bus 112, which has the greatest number of terminals, is located centrally of the remaining busses and the two together define four quadrants such that all remaining busses and connection stations or terminal sets are disposed in two opposed quadrants.

As shown by the color designations and legends in FIG. 3, each of the busses 104–116 conform to a given one of the circuit nodes described previously. For example, the bus 104 conforms to the first circuit node 52 while the bus 108 conforms to the grounded circuit node shown at 50 and 78. The bus 110 conforms to the circuit node 60 while the bus 112 conforms to the second circuit node or neutral defined by the line 48. The bus 114 conforms to the circuit node 74 while the bus 116 conforms to the circuit node represented by the line 72 in the FIG. 2 schematic.

With the various wiring harnesses previously described connected to the associated electric components of the refrigeration apparatus, assembly of the total wiring system is accomplished simply by disposing the connectors 82, 86, 88, 92 and 100 on terminal sets 118, 120, 122, 124, and 126, respectively and connecting the connector 96 to the compressor circuit. It is estimated that approximately a 60% savings in labor is accomplished through use of the present invention over the prior art practice of assembling spade bindings on individual leads to terminal strips. It will further be appreciated that wiring errors can be eliminated simply by providing each of the connectors 82, 86, 88, 92 and 100 with slightly different exterior configurations and providing the terminal block 40 with corresponding means that will allow but a single one of the connectors to be located at a single position.

FIG. 4 illustrates a preferred form of terminal block 40. The same includes a base 140 from which an upstanding wall 142 configured as illustrated extends. The wall 142 defines a series of recesses 144, 146, 148, 150 and 152 for respective receipt of the connectors 82, 86, 88, 92 and 100, respectively; and the appropriate ones of the terminals 118–126 are located in appropriate ones of the recesses. It will be observed that the terminal block 40 illustrated in FIG. 4 is configured such that the components are in two opposed quadrants as previously mentioned and in the unoccupied quadrants, the base 140 is provided with apertures 156 which may receive threaded fastener as screws 158 (FIG. 3) whereby the terminal block 40 may be secured to the rear wall 42 of the compartment 12 as mentioned with the description of FIG. 1.

In viewing FIG. 4, it will be appreciated that the busses having fewer terminals than the central bus 112 are located progressively more remote from the bus 112. Similarly, the connection stations or recesses having fewer terminals than the central recess 148 are located progressively more remote from the central recess 148. Further, it will be appreciated that the busses and terminals have been arranged such that there are no gaps, or empty spaces, between the various leads which connect to each of the individual connectors. By following this arrangement, the physical size of the terminal block 40 and the individual connectors 82, 86, 88, 92 and 100, and materials required to make the same are minimized thereby minimizing component expense.

Thus, the wiring structure of the present invention minimizes assembly time thereby minimizing labor costs, provides means whereby wiring errors may be avoided, and does so in a low cost structure requiring a minimum of materials and fabrication.

I claim:

1. In a refrigeration apparatus arranged for operation from an electrical power source and having a plurality of electrical components including a compressor, a fan, a thermostat, and a light, and wherein one or more electrical leads are connected to each of said components, the combination of:

a plurality of electrical connectors, each of said connectors receiving at least two of selected ones of said leads and being elongated, receiving the associated leads in a single straight row;

a terminal block defining a plurality of side-by-side, connector-receiving connection stations, each of said stations being elongated and configured to receive a corresponding connector;

means disposed at each connection station and carried by each connector for establishing an electrical connection when a connector is received by the associated station; and a plurality of electrically separated busses carried by said terminal block and extending linearly between the connecting stations to effect electrical interconnection between preselected leads associated with different ones of said connectors;

said busses being generally parallel to each other and extending generally transversely to the direction of elongation of said connection stations;

the bus effecting the greatest number of electrical connections being located centrally of the remaining busses.

2. The regrigeration apparatus of claim 1 wherein the connection station effecting the greatest number of electrical interconnections is located centrally of the remaining stations.

3. The refrigeration apparatus of claim 2 wherein said busses have plural terminals in varying numbers and said connection stations are defined by recesses in said terminal block, the recesses having the greatest number of terminals and the busses extending between the greatest number of recesses defining four quadrants, the remaining recesses and busses being located solely in two opposite ones of said quadrants.

4. In a refrigeration apparatus arranged for operation from an electrical power source and having a plurality of electric components including a compressor, a fan, a thermostat, a light, and a heating element, a cabinet containing said components and defining a refrigeration space, and at least two flexible electrical leads connected to each of said components associated with said cabinet, the combination of:

a plurality of one piece multiple terminal connectors each associated with two or more of selective ones of said leads, said terminal connectors being linearly elongated to receive the associated leads in a single straight row;

a terminal block mounted within said cabinet and having a plurality of linear, side-by-side, elongated, multiple terminal connection stations, at least some of said stations being staggered with respect to others of said stations, with each station being adapted to receive a corresponding one of said connectors;

a plurality of electrically separated, side-by-side, linear busses in said terminal block with each said bus extending between at least two of said connection stations with each bus having connection means in each connection station to which it extends for electrical connection to the associated one of said connectors, said connection stations extending transversely to said busses;

at least one of said connection stations having a greater number of said connection means than others of connection stations and being located centrally of said other connection stations with the connection stations having progressively lesser numbers of said connection means being progressively more remote from said one connection station;

and at least one of said busses having more of said connection means than others of said busses and being located centrally of the others of said busses with the busses having progressively fewer of said connection means being progressively more remote from said one bus;

said leads and said connectors associated therewith defining a plurality of wiring harnesses for various ones of said electrical components.

* * * * *